United States Patent [19]

Cole

[11] Patent Number: 4,970,738

[45] Date of Patent: Nov. 20, 1990

[54] PATIENT TRANSFER DEVICE

[75] Inventor: David R. Cole, Beaverton, Oreg.

[73] Assignee: Wy'East Medical Corporation, Clackamas, Oreg.

[21] Appl. No.: 375,032

[22] Filed: Jun. 30, 1989

[51] Int. Cl.[5] ..... A61G 7/10

[52] U.S. Cl. ..... 5/81.13; 5/88; 414/522; 414/921

[58] Field of Search ..... 5/81 R, 81 B, 81 C, 5/86, 88; 296/20; 414/343, 345, 392, 522, 525.1, 921

[56] References Cited

U.S. PATENT DOCUMENTS

| | | | |
|---|---|---|---|
| 2,834,030 | 5/1958 | Jones | 5/81 R |
| 3,115,646 | 12/1963 | Lee | 5/81 R |
| 3,493,979 | 2/1970 | Koll et al. . | |
| 3,579,672 | 5/1971 | Koll et al. . | |
| 3,593,351 | 7/1971 | Dove | 5/81 R |
| 3,765,037 | 10/1973 | Dunkin . | |
| 3,854,152 | 12/1974 | Chez | 5/81 C |
| 3,947,902 | 4/1975 | Conde et al. . | |
| 4,073,016 | 12/1978 | Koll . | |
| 4,077,073 | 3/1978 | Koll et al. . | |
| 4,631,761 | 12/1986 | Lederman . | |
| 4,680,818 | 7/1987 | Ooka et al. . | |
| 4,761,841 | 8/1988 | Larsen . | |

OTHER PUBLICATIONS

"Totalift" Operating Instruction Brochure by Wy'East Medical.

Hoxan Stretcher Series Brochure MC-0320 83-08-5-B-3 for Model HS-13 and HH-11 in Japanese.

Hoxan Stretcher Series Brochure 1.000/83.4/SB-N1 for Model HS-13 and HH-11 in English.

Adel "Solo Lift" Patient Transfer Stretcher Brochure.

*Primary Examiner*—Michael F. Trettel

*Attorney, Agent, or Firm*—Klarquist, Sparkman, Campbell, Leigh & Whinston

[57] ABSTRACT

A patient transfer device adapted to be a component of a patient transport stretcher, chair or gurney is disclosed. A rigid articulated support having a head portion and a lower portion hinged to one another is adapted to be attached to a stretcher having a Fowler mechanism. A self locking reversible gearbox which can be manually driven from either side of the transport device is attached to the support. The gearbox drives an articulated output shaft to which rollers are attached. The rollers drive an endless belt beneath the support. The endless belt has finite lengths of low friction webbing attached. The low friction webbing wraps around the support and across the top thereof between the support and a flexible semirigid transfer sheet. The low friction webbing is attached to the semirigid sheet such that when the gearbox is activated the transfer sheet is moved across the rigid support to extend outwardly from either side of the rigid support.

11 Claims, 4 Drawing Sheets

PATIENT TRANSFER DEVICE

TECHNICAL FIELD

This invention relates to an apparatus for transporting an object from a fixed support such as a bed, an operating table, x-ray table or examining table to a movable support such as a stretcher, articulated chair or gurney. Specifically a device is disclosed which can be attached to an existing support or integrated into a support which allows a patient to be safely transported from a hospital bed to the stretcher.

BACKGROUND OF THE INVENTION

A major cause of patient and hospital worker injuries occurs transferring patients from hospital beds to transport stretchers or gurneys. The hospital workers must physically lift the patient and move them from the bed to the stretcher. Since the stretcher must be adjacent to the bed in order to transfer the patient, the length of the reach and the angle of lifting becomes a major problem for the hospital workers. This can cause back and other injuries to the hospital workers. Transferring the patient is also labor intensive in that it requires at least two and as many as six attendants to bodily lift or slide or in some cases roll the patient between the hospital bed and the stretcher.

This kind of manhandling of non-ambulatory patients is typically uncomfortable for the patient and may even be detrimental to the patient's condition depending upon the nature of the patient's injury or illness. The mere movement may aggravate the patient's injury. The patient may be dropped or the patient may slip between the bed and the stretcher.

The prior art discloses various hospital stretcher or gurney improvement devices intended to minimize patient discomfort and labor requirements. U.S. Pat. No. 3,493,979 to Koll et al, for example, discloses a transfer device which utilizes a pair of endless belts, one on top of the other. To advance the device toward a patient the upper belt is rotated in a direction opposite the lower belt which forces the upper belt outwardly. When the patient has been reached the lower belt is locked and the upper belt is rotated in a direction to bring the patient on to the upper belt. The upper belt is then locked and the lower belt is rotated to translate the upper belt and patient over the stretcher. The belts are supported by a mechanically complex coupling arrangement including telescoping guide rails. Several subsequent patents improved upon this basic invention. U.S. Pat. No. 3,579,672 to Koll et al added non-rigid supporting fingers to support the endless belts. Dunkin, U.S. Pat. No. 3,765,037 added primary and secondary brakes and an automatic belt tensioning arrangement. Koll et al, U.S. Pat. No. 4,073,016 retained the endless upper belt but replaced the lower endless belt with a finite length belt rigidly attached to one side of the stretcher and extensible from the other side of the stretcher. The finite length belt wrap about a separator plate to increase the width of operation of the transfer device to greater than the width of the endless belt. Koll et al, U.S. Pat. No. 4,077,073 improved upon this design by providing an improved means to align the tracking of the upper belt.

All of the above devices although useful and improvements over the prior art are complex and can only be operated from one side. The present invention overcomes these problems and limitations.

DISCLOSURE OF THE INVENTION

It is an object of the invention to provide a patient transfer device which may be attached to an existing hospital stretcher or gurney or which may be built integral with a stretcher or gurney.

It is a further object of the invention to provide a transfer device which can easily and safely transfer a patient to and from a hospital bed, x-ray table, operating table or examination table onto a moveable stretcher, gurney, or chair from either side of the stretcher, gurney, or chair.

It also is an object of the invention to provide a transfer device which can be operated from either side of an articulated chair, stretcher or gurney.

Another object of the invention is to provide a transfer device wherein the drive mechanism is self locking in the respect that it cannot be driven by rotation of the output.

The transfer device of the present invention has a rigid load carrying member. The rigid member has a head portion and a bottom portion. The head portion is hinged to the bottom portion by a hinge member. A semi-rigid transfer apron overlays the rigid member. A mattress is attached to the semi-rigid transfer apron.

A plurality of pairs of finite length low friction belts are attached to the transfer apron. One of each of the pairs of finite length belts is attached to a first side of the transfer apron. The other belt of each pair of finite length belts is attached to the opposite or second side of the transfer apron. All of the finite length belts extend beneath the transfer apron and extend across the transfer apron on top of the rigid support. Each of the belts in a pair of belts lie in a side-to-side non-overlapping relationship. The finite length belts then extend about a respective edge of the rigid support and wrap beneath the rigid support.

A plurality of endless belts are supported beneath the rigid support. There is one endless belt for each pair of finite lengths of belts. Each of the endless belts is supported by a drive roller on one side and an idle roller on the other side. Each of the drive rollers is driven by an output shaft from a gearbox. The gearbox includes a drive mechanism which is self locking. The gear box is driven by an input shaft which can be driven by a crank from either side of the transfer device.

Each pair of finite length belts is attached to a common endless belt. Rotation of the endless belt causes one of the pair of finite length belts to be wound about the endless belt while simultaneously the other finite length belt is being unwound from about the endless belt. Thus rotation of the crank causes the transfer apron to be translated laterally across the rigid support, beyond the edge of the rigid support to lay across the hospital bed.

Other objects and advantages of the present invention will be apparent from the following description of a preferred embodiment thereof and from the attached drawings.

BEST MODE FOR CARRYING OUT THE INVENTION

Figure 1:
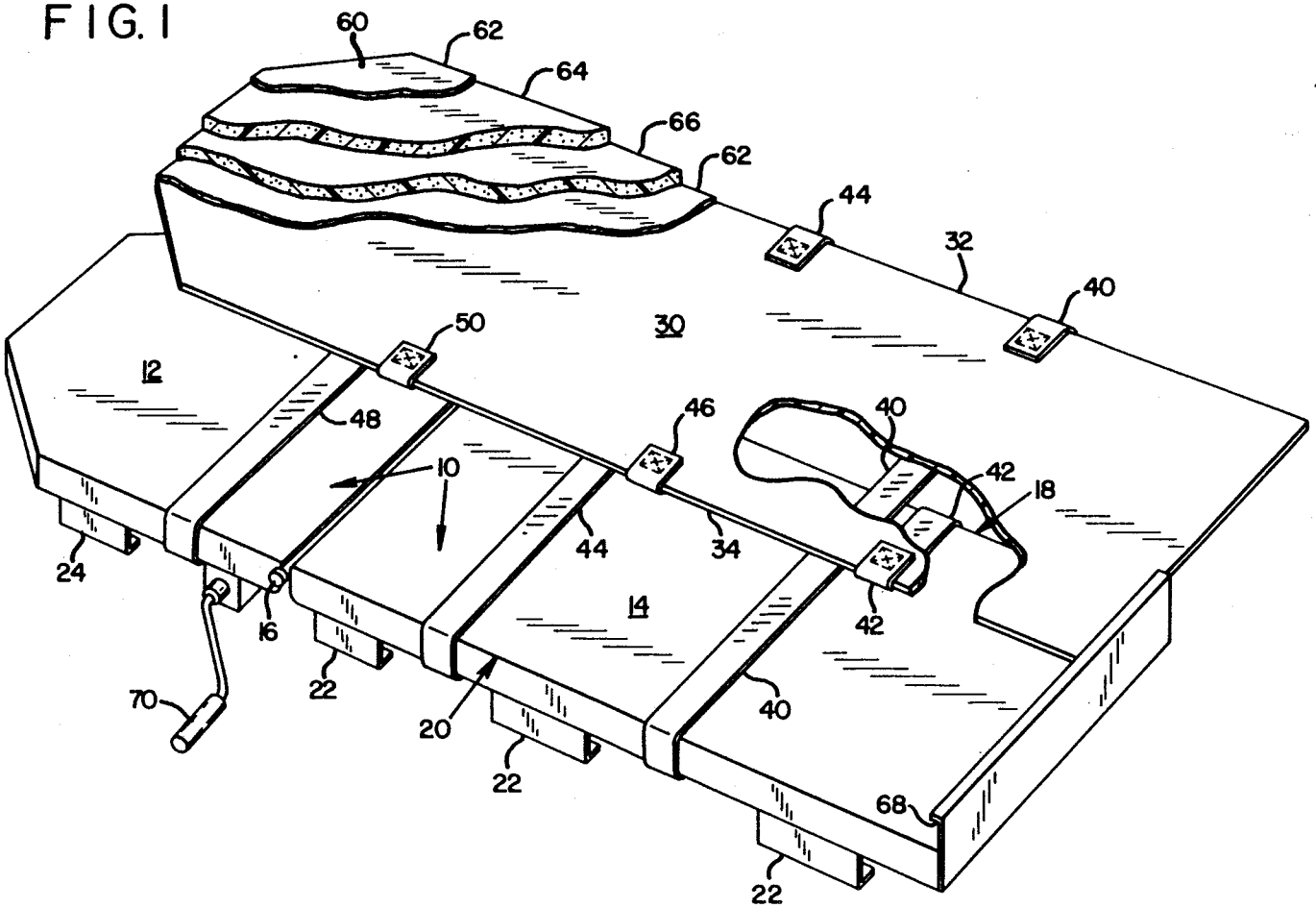
FIG. 1 is a top perspective view of the patient transfer device of the present invention partially broken away and extended to one side.

Referring to FIG. 1, a rigid support or load carrying member 10 is shown. The rigid support 10 has a head portion 12 and a lower portion 14 hinged at a hinge member 16. The head portion 12 and the bottom portion 14 may be made of aluminum, steel, plastic or other suitable material. The material of a preferred embodiment is a self skinning injection molded plastic foam. The rigid support 10 has a first edge 18 and an opposite or second edge 20. The rigid support 10 has fixed attachment standoffs 22 on the lower portion 14 and slide attachment standoffs 24 on the head portion 12. The fixed and slidable attachment standoffs are for attaching the patient transport device to an existing stretcher or gurney by means known in the art such as rivets or threaded fasteners. Standoffs 22 and 24 would not be needed of course if the patent transfer device is incorporated into a transport mechanism as original equipment.

A flexible semi-rigid transfer apron 30 lies on top of the rigid support 10. The transfer apron 30 can be made of any flexible semi-rigid sheet material such as high density polyethylene or polypropylene. In a preferred embodiment the material is 3/16" thick high density polyethylene. The transfer apron 30 has a first edge 32 and an opposite or second edge 34.

A plurality of pairs of low friction finite length belts are attached to transfer apron 30. In the preferred embodiment shown in FIG. 1, the belts may be sewn to the top of transfer apron 30. Other attachment methods such as hook and loop fasteners may be used. In the illustration, three pairs of belts are illustrated and explained below. It should be noted that any number of pairs of belts may be used. Belt 40 and belt 42 comprise the first pair of belts. Belt 40 is attached to the first edge 32 of transfer apron 30, extends beneath the transfer apron 30, on top of the bottom portion 14 of rigid support 10. Belt 40 extends about the second edge 20 of rigid support 10 and goes beneath the rigid support. The other belt 42 of the first pair of finite length belts is attached to the second edge 34 of transfer apron 30, extends beneath the transfer apron 30, on top of rigid support 12 in a direction opposite that of belt 40. Belt 42 wraps around first edge 18 of rigid support 10 and goes beneath the rigid support 10.

The second pair of finite length belts is comprised of belts 44 and 46. Belt 44 is attached to first edge 32 of transfer apron 30, extends beneath transfer apron 30, on top of bottom portion 14 of rigid support 10. Belt 44 extends about second edge 20 of rigid support 10 and goes beneath rigid support 10. The other belt 46 of the second pair of finite length belts attaches to the second edge 34 of transfer apron 30, extends beneath transfer apron 30, on top of rigid support 10 in a direction opposite to that of belt 44. Belt 46 wraps about the first edge 18 of rigid support 10 and goes beneath the rigid support 10.

The third pair of finite length belts is comprised of belts 48 and 50. Belt 48 is attached to the first edge 32 of transfer apron 30, extends beneath transfer apron 30, on top of the top portion 12 of rigid support 10. Belt 48 extends about second edge 20 of rigid support 10 and goes beneath rigid support 10. The other belt 50 of the third pair of finite length belts attaches to the second edge 34 of transfer apron 30, extends beneath transfer apron 30, on top of rigid support 10 in a direction opposite that of belt 48. Belt 50 wraps about the first edge 18 of rigid support 10 and goes beneath rigid support 10.

Belts 40, 42, 44, 46, 48 and 50 are made of a low friction material such as polyester or nylon webbing material similar to that used for automotive seat belts. The attachment points of the first of each pair of belts on the first edge 32 of the transfer apron 30 is offset in a longitudinal direction by the width of the belting material from the attachment point of the other of each pair of belts attached to second edge 34 of transfer apron 30. This allows the pair of belts to lie beneath the transfer apron in a side-by-side non-overlapping relationship.

A mattress assembly 60 overlays flexible support 30. Mattress assembly 60 has a cover 62 covering the top, bottom and all sides of the mattress. The mattress cover is made from an electrically conductive, flame retardant, bacteria resistent fabric. A suitable fabric is manufactured by Herculite Products, Inc. of New York, N.Y. under the trade name of 'LECTROLITE TM. Conventional mattress material may of course be used. The mattress in a preferred embodiment is made from two layers of polyurethene foam pads. The upper foam pad 64 has a lower density than the lower foam pad 66. This allows a comfortable mattress in a thin space by having a low density foam near the patient, yet preventing strike through of the body by placing a higher density foam close to the rigid support. The mattress assembly may be attached to the transfer apron 30 by any suitable means such as hook and loop fasteners, snaps or straps.

Because the head portion 12 of the rigid support may be elevated about pivot point 16 above lower portion 14, a lower support and guide 68 is provided on the bottom of the lower portion 14 of the rigid member 10. This inverted "L" structure prevents the flexible apron 30 from slipping down the rigid support 10.

Figure 2:
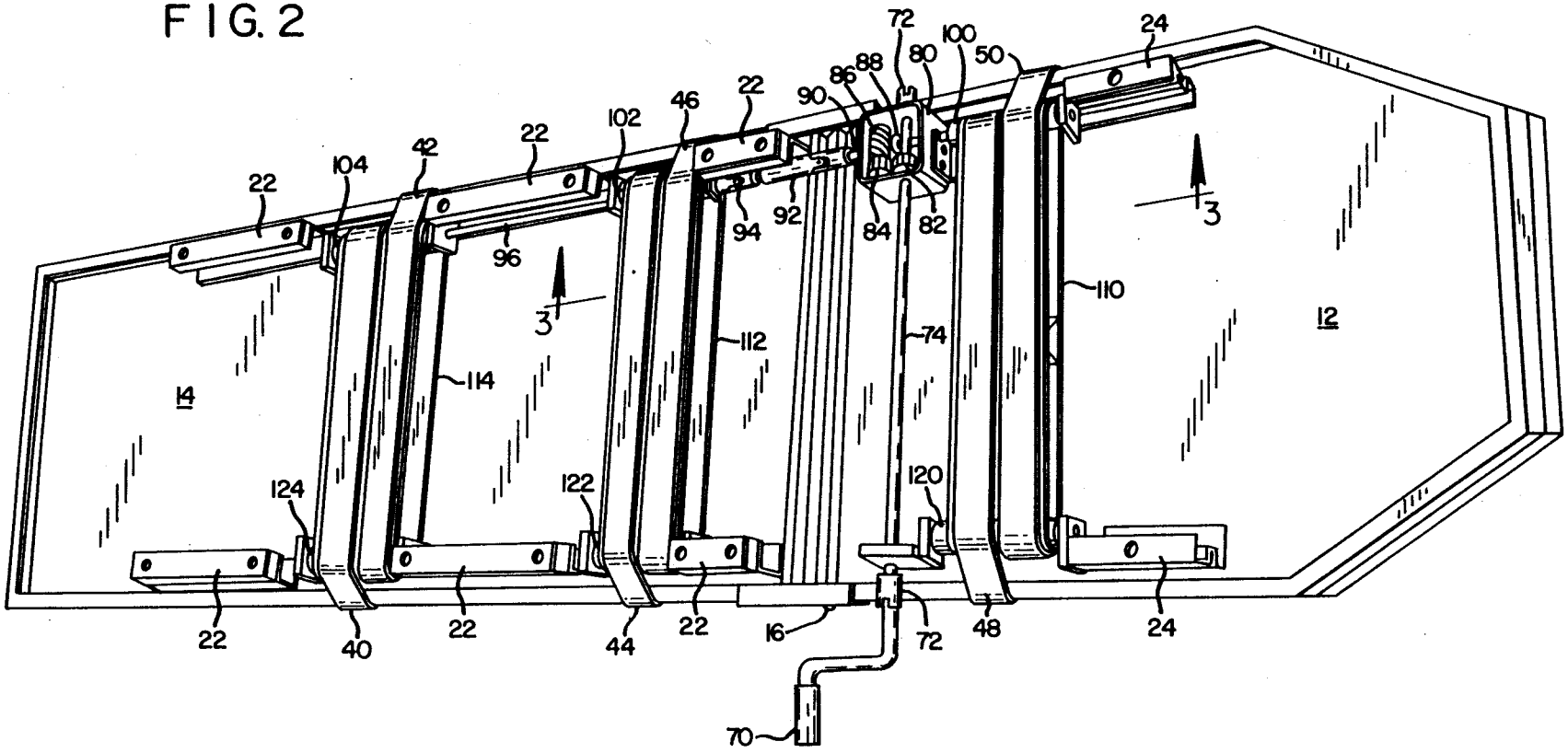
FIG. 2 is a bottom perspective view of the patient transfer device of the present invention.

A removable hand crank 70 allows manual rotation force to be inputted to the patient transfer device. Referring to FIG. 2, it can be seen that hand crank 70 can be inserted into a crank connector 72 on either side of the rigid support 10. The crank connectors 72 are attached to each side of an input shaft 74. A spur gear 82 is rigidly attached to input shaft 74 and is in tooth to tooth engagement with a second spur gear 84. Spur gear 84 drives a worm gear 86 which is in engagement with a worm wheel 88. Worm wheel 88 is affixed to an output shaft 90. In a preferred embodiment, the input shaft 74, gear box 80, and output shaft 90 are all supported on the underside of the head portion 12 of rigid support 10. The output shaft is articulated in the area of hinge number 16 with a first universal joint 92. Universal joint 92 has an integral slip joint to allow for longitudinal elongation since the pivot point of universal joint 92 is not coincidental with the pivot point of hinge member 16. A second universal joint 94 is connected to a lower output shaft 96 to complete the output shaft assembly. The lower output shaft 96 is supported on the bottom portion 14 of the rigid assembly 10.

It should be noted that the gear box in the preferred embodiment utilizes the spur gear combination 82 and 84 to effectuate a gear ratio in which one rotation of the hand crank 70 would produce a translation of the transfer apron 30 of approximately ⅞ of an inch. In an alternate embodiment, the input shaft 74 could drive the worm gear 86 directly. The diameter of the worm wheel 88 would need to be increased substantially however in order to achieve the proper gear ratio. The worm gear and worm wheel produce a self locking drive mechanism. Once the rotation of the hand crank is stopped the transfer apron is locked in position until the hand crank is again rotated.

The output shafts 90 and 96 drive a plurality of drive rollers 100, 102 and 104. Drive roller 100 is attached to output shaft 90 and supported by suitable bearings in the head portion 12 of the rigid support 10. Drive rollers 102 and 104 are attached to output shaft 96 ad are supported by suitable bearings on the lower portion 14 of the rigid support 10.

A plurality of endless belts 110, 112 and 114 are trained over drive roller 100, 102 and 104 respectively. Each endless belt is made from a high friction webbing material such as vinyl coated cotton webbing similar to the material used to make conveyor belts. Each belt is approximately twice the width of the finite length belts. This allows the finite length belts to be attached to each endless belt in a side to side relationship without any overlap as will be explained below.

The endless belts are supported on the other side of rigid support 10 by idle rollers 120, 122 and 124. The idle rollers are supported by suitable bearings mounted to the rigid support 10. In this manner the endless belts are free to rotate beneath the rigid support 10 by circumscribing the drive rollers and the idle rollers. The endless belts 110, 112 and 114 are all the same length and drive rollers 100, 102 and 104 are the same diameter so that rotation of the crank 70 will cause each endless belt to rotate the same amount.

Figure 3:
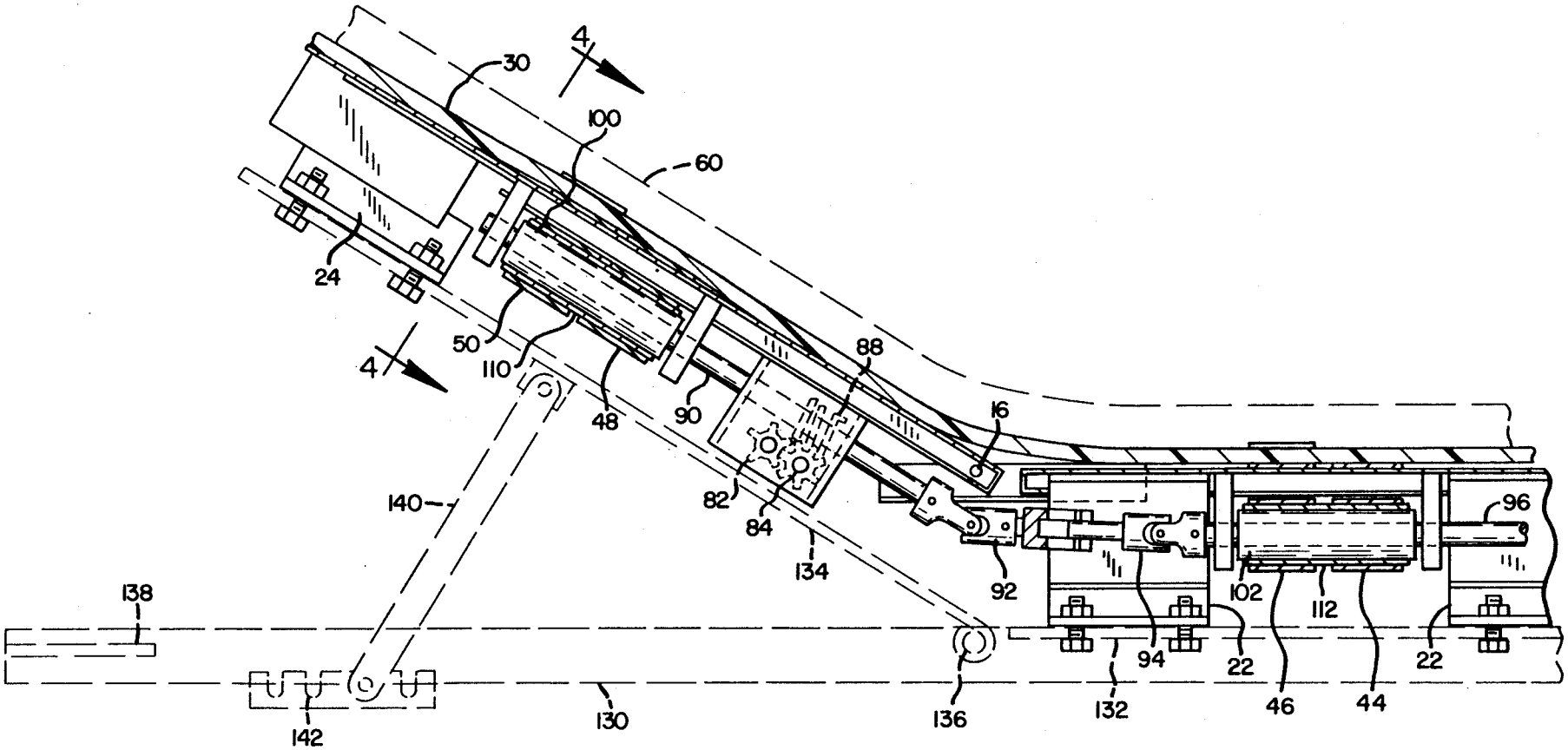
FIG. 3 is a longitudinal cross section of a portion of the patient transfer device of the present invention along section lines 3—3 of FIG. 2, rotated into a usage position with the head portion elevated.

Endless belt 100 has the ends of finite length belts 48 and 50, which extend beneath the rigid support 10, attached to opposite sides of the endless belt such that finite length belts 48 and 50 lie in a side to side relationship, as shown in FIG. 3. Belts 44 and 46 are attached to endless belt 112 in a similar manner. Finite length belts 40 and 42 are attached to endless belt 114.

FIG. 3 also shows a portion of an existing stretcher or gurney structure to which the transfer device of the invention is attached. A Fowler mechanism allows a patient's head to be elevated and is part of the existing stretcher. The existing structure or gurney has a frame work 130. The frame work 130 has a lower deck structure 132 and an upper deck structure 134. The upper deck structure 134 is hinged to the framework 130 by a pivot member 136. A stop 138 is provided on the framework 130 to support the upper deck structure 134 when it is in a down position. A support arm 140 is pivotally attached to the upper deck structure 134 and engages a slotted retainer 142 mounted on the framework 130 to hold the upper deck structure in an angled elevated position. The patient transfer device attaches to the upper deck structure 134 by means of slidable support 24 and to the lower deck structure 132 by fixed supports 22. It can be seen that the pivot member 16 of the transfer device and the pivot point 136 of the existing gurney are not coincidental. This necessitates the slidable support 24 to allow the relative motion of the head portion 12 of the rigid support 10 to the upper deck 134 of the existing gurney.

Figure 4:
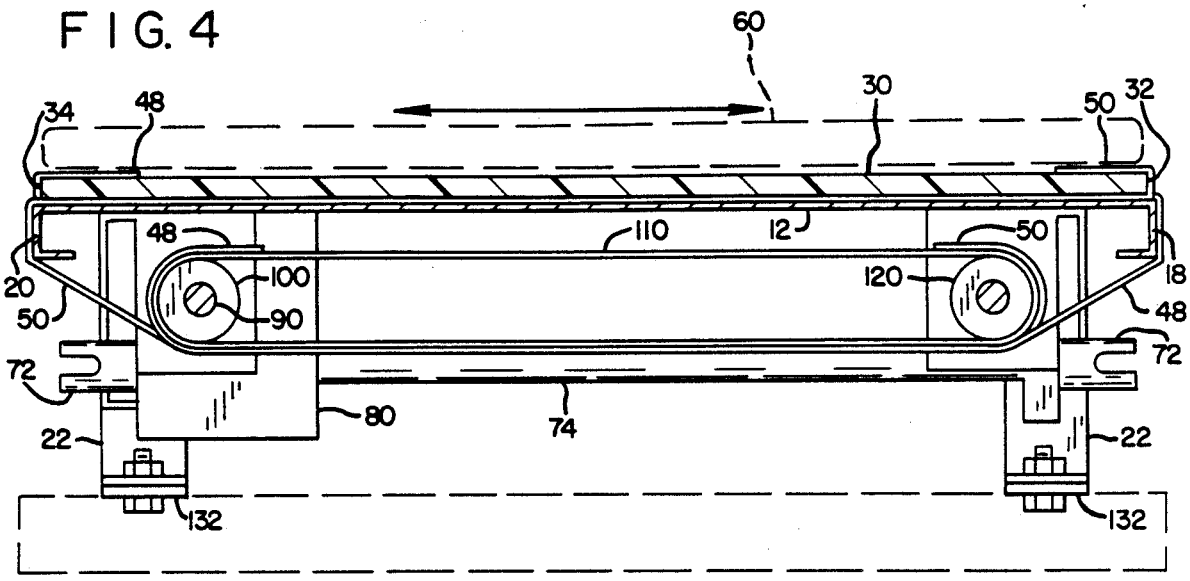
FIG. 4 is a cross section of the patient transfer device of the present invention along section lines 4—4 of FIG. 3.

FIG. 4 shows how the arrangement of the finite length belts attach to the endless belts. In the transport or retracted position the transfer apron 30 with the mattress 60 overlays the rigid support 10. The endless belt 110 is supported beneath the rigid structure 10 and circumscribes drive roller 100 and idle roller 120. Finite length belt 48 is attached to endless belt 110, goes down on the outside of the endless belt 110, about drive roller 100, lies beneath the lower reach of endless belt 110, goes up around idle roller 120, around edge 18 of the hinge portion 12 of rigid support 10, between rigid support 10 and transfer sheet 30, about edge 34 of transfer sheet 30 and attaches to the top of transfer sheet 30. Finite length belt 50 is attached to the endless belt 110, goes down on the outside of endless belt 110 and idle roller 120, beneath the lower reach of endless belt 110, up around drive roller 100, around edge 20 of the head portion 12 of rigid support 10, between rigid support 10 and transfer sheet 30, about edge 32 and attaches to the top of transfer sheet 30.

Figure 5:
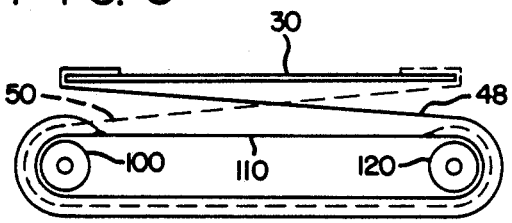
FIG. 5 is a schematic of the belt arrangement of the patient transfer device in the retracted position.
Figure 6:
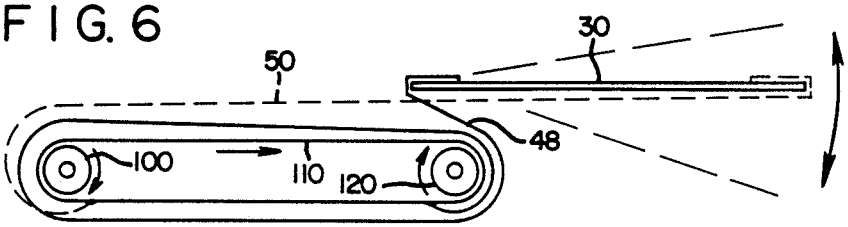
FIG. 6 is a schematic of the belt arrangement of the patient transfer device extended to the right.
Figure 7:
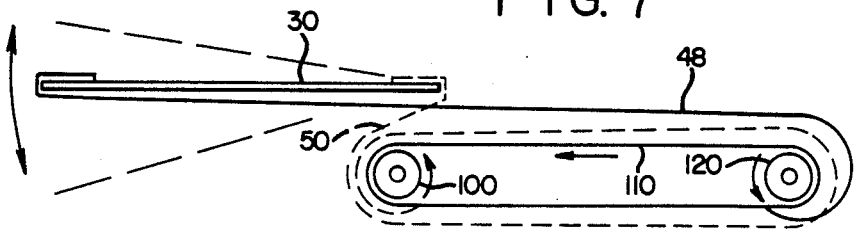
FIG. 7 is a schematic of the belt arrangement of the patient transfer device extended to the left.

A representative example of the operation of the belts can be seen by referring to FIGS. 5, 6 and 7. In a beginning position or transport or retracted position as shown in FIG. 5, endless belt 110 circumscribes drive roller 100 and idle roller 120. Finite length belts 48 and 50 are attached to endless belt 110, wrap about the rigid support 10 (not shown for clarity), crosses on top of rigid support 10 and beneath transfer apron 30. For purposes of clarity finite length belt 48 is shown as a solid line and finite length belt 50 is shown as a dashed line. Belts 48 and 50 are attached to transfer apron 30. In the position represented by FIG. 5, transfer apron 30 is centered over rigid support 10. In FIG. 6, the crank 70 has been rotated rotating drive roller 100 in a clockwise motion. Endless belt 110 rotates in a clockwise motion winding finite length belt 48 about endless belt 110 and unwinding finite length belt 50 from the endless belt 110. This causes transfer sheet 30 to be translated to the right, overlaying a first edge of the rigid support 10. In a similar manner, transfer sheet 30 may be translated to the left as shown in FIG. 7 by causing the drive roller 100 to be rotated in a counter clockwise direction. This causes endless belt 100 to be rotated counterclockwise, winding finite length belt 50 about endless belt 110 and unwinding finite length belt 48 from endless belt 110.

In the embodiment shown in the attached drawings, the patient transfer device is firmly attached to an existing stretcher or gurney by bolts, rivets, or other suitable means by fixed support 22 and slidable support 24. The structure on the gurney is positioned adjacent to the hospital bed and hand crank 70 is inserted into the crank connector 72 on the side away from the hospital bed. The hand crank 70 is rotated, causing the transfer sheet 30 to extend over one edge of the rigid support 10 on top of the hospital bed. The patient is merely rolled onto the mattress on top of transfer apron 30 and the rotation of the hand crank is reversed. This brings the patient and the transfer sheet 30 back on top of rigid support 10. Cessation of rotation of hand crank 70 causes the transfer apron 30 to be locked over rigid support 10.

Although the specific embodiment described above has only a head portion 12 and a bottom portion 14 with a single pivot 16, it should be understood that multiple pivot points are possible and contemplated within the scope of the invention. Multiple pivot points would allow the patient transfer device to be used in a multiply articulated structure such as a chair.

The drive means for the input shaft 74 has also been described as a crank 70 mating with a coupler 72. Those skilled in the art should appreciate that this is meant to be explanatory and not limiting in that a crank could be permanently attached to each side with suitable coupling or clutching mechanisms as are known in the art. Similarly, hydraulic or electric motors could provide the means to drive the output shaft.

The gearbox 80 is intended to be able to be driven by clockwise or counterclockwise rotation of the input shaft but be incapable or rotation hence self locking if rotation is caused by the output shaft. This prevents inadvertent movement caused by the weight of the patient. Although a worm and worm wheel is described, it is intended that any mechanical mechanisms which achieves this goal is sufficient.

Of course it should be understood that a wide range of changes and modifications can be made to the preferred embodiment described above. It is therefore intended that the foregoing description be regarded illustratively rather than limiting and it is understood that it is the following claims, including all equivalents, which are intended to define the scope of the invention.

INDUSTRIAL APPLICABILITY

The improved patient transfer device described above can be attached to an existing hospital transport stretcher or gurney allowing a few number of attendants to easily and safely transfer a patient from a hospital bed, x-ray table or operating table to a transport stretcher. The transfer device eliminates the need to physically lift the patient. The possibility of the patient accidentally falling between the transport stretcher and the hospital bed is eliminated.

I claim:

1. An object transfer device comprising:

a semi-rigid transfer apron having a first side and a second side;

a rigid support lying beneath said transfer apron, said rigid support having a first side corresponding to the first side of said transfer apron and a second side corresponding to the second side of said transfer apron;

a plurality of pairs of flexible finite length belts, each of said pair of belts comprised of a first belt having a first end and a second end and a second belt having a first end and a second end;

the first end of the first belt of each pair of finite length belts attached to the first side of the transfer apron and extending beneath the transfer apron on top of the rigid support and wrapping about the second side of the rigid support such that the second end of the first belt of each pair of finite length belt lies beneath the rigid support on the second side of the rigid support;

the first end of the second belt of each pair of finite length belts attached to the second side of the transfer apron and extending beneath the transfer apron on top of the rigid support in a side-by-side relationship with the corresponding first belt of the same pair of finite length belt and said second belt wrapping about the first side of the rigid support such that the second end of the second belt of each pair of finite length belts lies beneath the first side of the rigid support;

a plurality of endless belts located beneath said rigid support, each of said endless belts attached to the second end of the first belt of each pair of finite length belts and simultaneously attached to the second end of the second belt of each pair of finite length belts;

an actuation means to selectively rotate said endless belts to extend or retract each finite length belt attached to each of said endless belts, said actuation means located beneath said rigid support; and said actuation means adapted to rotate said endless belts to either extend the first belt of each pair of finite length belts and simultaneously retract the second belt of each pair of finite length belts to extend the first side of the transfer apron beyond the first side of the rigid support or to extend the second belt of each pair of finite length belts and simultaneously retract the first belt of each pair of finite length belts to extend the second side of the transfer apron beyond the second side of the rigid support.

2. A patient transfer device comprising:

a semi-rigid transfer apron having a first edge and a second edge;

a rigid support having a first side and a second side extending beneath said apron;

a plurality of pairs of finite length belts one of each said pair of finite length belts attached to the first edge of said transfer apron and the other of each of said pair of finite length belts attached to the second edge of said transfer apron and said plurality of pairs of finite length belts extending beneath said apron across the top of said rigid support;

a plurality of endless belts extending laterally of and located beneath the rigid support;

each pair of finite length belts attached to one of said endless belts;

roller means supporting said endless belts;

a drive shaft for driving said roller means;

the drive shaft driven by a gearbox;

said gearbox being self locking, reversible and capable of being driven from either the first side or the second side of the rigid support; and a means to rotate said gearbox to extend said transfer apron selectively beyond either the first side or the second side of said rigid support.

3. A patient transfer device as recited in claim 2 wherein the semi-rigid transfer apron is a sheet of plastic material.

4. A patient transfer device as recited in claim 2 wherein the finite length belts are low friction polyester or nylon webbing material.

5. A patient transfer device as recited in claim 2 wherein the rigid support is molded from a plastic material.

6. A patient transfer device as recited in claim 2 wherein the rigid support is fabricated from metal.

7. A patient transfer device as recited in claim 2 wherein said endless belts are vinyl coated cotton webbing material.

8. A patient transfer device as recited in claim 2 wherein the gearbox includes a worm gear in engagement with a worm wheel.

9. An object transfer apparatus comprising:

a load carrying deck structure with a first edge and a second edge;

an extensible semi-rigid apron assembly having a first edge and a second edge lying atop the deck structure and adjustable between a retracted condition overlaying the deck structure and an extended condition located at least in part beyond either the first edge or the second edge of the deck structure over a surface to or from which an object is to be transferred;

a plurality of pairs of finite lengths of low friction flexible belts attached to said semi-rigid apron assembly;

one of said pair of finite length of belt attached to the first side of said semi-rigid apron assembly;

the other of said pair of finite length belt attached to the second side of the semi-rigid apron assembly;

said finite lengths of belt lying between the semi-rigid apron assembly and the deck structure;

said finite length of belt attached to the first side of the semi-rigid apron assembly wrapping about the second side of the deck structure and the finite length of belt attached to the second side of the semi-rigid apron wrapping about the first side of the deck structure;

a plurality of endless belts located beneath said deck structure;

each of said pair of finite length belt attached to one of said plurality of endless belts;

a winding element engaging each of said plurality of endless belts;

said winding element attached beneath the deck structure; and a means to rotate the winding element to rotate said endless belts to translate the semi-rigid apron assembly from a retracted position to an extended position and from an extended position to a retracted position.

10. A patient transfer device comprising:

an articulated rigid support having at least a head portion, a bottom portion, and a hinge therebetween;

a gearbox attached to the rigid support said gearbox having an input shaft;

the input shaft translating rotary motion to a worm gear;

said worm gear driving a worm wheel on an output shaft;

the output shaft supported on the rigid support and said output shaft being articulated in the area of the hinge;

a plurality of rollers attached to the output shaft;

a plurality of endless belts, each endless belt rotationally engaging each roller;

a plurality of idle rollers each rotationally engaging one of said endless belts, said plurality of idle rollers supported by said rigid support;

a pair of finite length transfer belts attached to each endless belt;

said transfer belts lying across a top surface of the rigid support, each of said finite length belt of said pair of finite length belts traversing said rigid support in opposite directions;

a semi-rigid transfer sheet lying atop said rigid support and attached to each pair of said finite length transfer belts such that each of said finite length transfer belt of each pair of said finite length transfer belt attaches to an opposite side of said transfer sheet; and a means to attach said rigid support to an existing stretcher or gurney.

11. A patient transfer device comprising:

a flexible semi-rigid transfer apron having a first side and a second side;

a plurality of pairs of low friction finite length flexible belts, each finite length belt having a first end and a second end;

the first end of one finite length belt of a pair of finite length belts attached to the first side of said transfer apron and extending beneath said transfer apron to said second side of said transfer apron and the first end of the other finite length belt of the same pair of finite length belts attached to the second side of the transfer apron and extending beneath said transfer apron to said first side of said transfer apron;

each of said finite length of belt wrapping about a rigid support;

a plurality of endless belts located beneath said rigid support and rotationally supported by said rigid support;

the second end of each finite length of belt of a pair of finite length of belt attached to one of said plurality of endless belts; and a means to simultaneously rotate each endless belt to move said pairs of finite lengths of belt to translate said transfer apron such that either the first side of said transfer apron or said second side of said transfer apron extends beyond said rigid support.

* * * * *